US012605615B2

(12) United States Patent
Chvala et al.

(10) Patent No.: US 12,605,615 B2
(45) Date of Patent: Apr. 21, 2026

(54) INSTRUMENTED BRIDGE HAND GLOVE FOR CUE SPORTS CUE GUIDANCE

(71) Applicant: Seybert's Billiard Corporation, Coldwater, MI (US)

(72) Inventors: Charles Francis Chvala, Verona, WI (US); Rick Matzke, Allen, MI (US); Mark Horton, Kalamazoo, MI (US); Sid Kreis, Coldwater, MI (US); Benjamin Weisensel, Poynette, WI (US)

(73) Assignee: SEYBERT'S BILLIARD CORPORATION, Coldwater, MI (US)

( * ) Notice: Subject to any disclaimer, the term of this patent is extended or adjusted under 35 U.S.C. 154(b) by 0 days.

(21) Appl. No.: 18/737,800

(22) Filed: Jun. 7, 2024

(65) Prior Publication Data

US 2025/0375694 A1 Dec. 11, 2025

(51) Int. Cl.
*A63B 71/14* (2006.01)
*A63B 71/06* (2006.01)

(52) U.S. Cl.
CPC ..... *A63B 71/148* (2013.01); *A63B 71/06* (2013.01)

(58) Field of Classification Search
CPC ..... A63B 71/148; A63B 71/06; A63B 71/14; A63B 71/143; A63B 71/145; A63B 71/146
See application file for complete search history.

(56) References Cited

U.S. PATENT DOCUMENTS 4,025,962 A * 5/1977 Hartung ..... A63B 71/148 2/161.6
2016/0069760 A1* 3/2016 Chiang ..... G01L 5/00 340/626

* cited by examiner

*Primary Examiner* — Khoa D Huynh
*Assistant Examiner* — Erick I Lopez
(74) *Attorney, Agent, or Firm* — CRGO Global; Steven M. Greenberg

(57) ABSTRACT

A performance monitoring bridge hand glove for cue sports cues includes a hand enclosure including segments from hand to at least knuckle for each of a middle finger, a pointer finger and a thumb. The glove further includes a thumb webbing sensor array embedded in a webbing portion between the thumb and the pointer finger, and a middle finger sensor array embedded in a distal end of one of the segments for the middle finger. The glove yet further includes a switch communicatively coupled to the thumb webbing sensor array and the middle finger sensor array and switched on by the thumb webbing sensor array and the middle finger sensor array. Finally, the glove includes a feedback element activated by the switch and a power source fixed to the hand enclosure powering the arrays, the switch and the feedback element.

10 Claims, 3 Drawing Sheets

INSTRUMENTED BRIDGE HAND GLOVE FOR CUE SPORTS CUE GUIDANCE

BACKGROUND OF THE INVENTION

Field of the Invention

The present invention relates to the field of sporting gloves and more particularly to bridge hand gloves for cue sports cue guidance.

Description of the Related Art

Cue sports refer to a vast array of sporting games of skill played with a cue and billiard balls in which the cue strikes individual ones of the billiard balls to cause the balls to move along a cloth-covered table bounded by elastic bumpers. Cue sports can be classified according to the nature of the cloth table. In Carom billiards, the cloth table lacks "pockets" and otherwise merely defines a rectangular playing surface. In contrast, in the game of Pool, the table incorporates six pockets. Likewise, the games of Snooker, English billiards, and Russian pyramid the table includes six pockets. But in all instances, play begins with the striking of the cue ball by the cue.

The cue refers specifically to a cue stick. The cue stick, used to strike the billiard ball and in most instances, a "cue ball", generally is long pole, tapered in form. The basis of all cue sports is the operation of the cue leading up to and following the striking of the billiard ball with the distal tip of the cue while the billiard ball rests on the surface of the table. The operation of the cue is referred to as the "stroke", which is the movement made by the cueing arm of the player as the player moves the cue towards the billiard ball and following the contacting of the billiard ball with the tip.

Ordinarily, it is desirable to strike the cue ball with the cue with as straight a stroke as possible striking the cue ball at a central point of a surface of the cue ball facing the player. As such, the direction of movement of the ball will be in line with the direction of movement of the cue and the velocity and number of revolutions of the cue ball as the cue ball moves towards its target can be largely controlled by the force imparted onto the central point of the surface of the cue ball by a stroking of the cue by the player.

In order to permit the player with a higher degree of control over the cue during operation of the cue, the player oftentimes may opt for a bridge hand glove. A bridge hand glove is a glove worn by the player on the hand acting as a stable bridge for the cue, e.g. contacting the cue at the position of the cue closest to the cue ball relative to the other hand which operates the shaft and propels the cue towards the cue ball. A common posture for the bridge hand during operation of the cue is to connect the pointer finger to the thumb around the circumference of the cue with the cue proceeding past the thumb and pointer finger over a top portion of the middle finger. Optimally, a modest pressure resulting from the contact of the cue on the top surface of the middle finger and the thumb webbing between the thumb and pointer finger results.

However, it is commonly understood that many players, in error, position the cue improperly in the bridge hand so as to not simultaneously contact the top surface of the middle finger and the thumb webbing between the thumb and pointer finger. Another common error is for the player to grip the cue too tightly, applying too much pressure at either or both of the top surface of the middle finger and/or the thumb webbing between the thumb and pointer finger. The result in either case is an improper stroke of the cue impeding a straight, striking of the cue ball with optimum force. However, prior to the striking of the cue ball, it will not necessarily be apparent to the player that the handling of the cue by the bridge hand is correct.

BRIEF SUMMARY OF THE INVENTION

Embodiments of the present invention address deficiencies of the art in respect to cue stick handling by the bridge hand of a cue sports player and provide a novel and non-obvious method, system and computer program product for a performance monitoring bridge hand glove. In an embodiment of the invention, a performance monitoring bridge hand glove for cue sports cues includes a hand enclosure including segments from hand to at least a knuckle for each of a middle finger, a pointer finger and a thumb. The glove further includes a thumb webbing sensor array embedded in a webbing portion between the thumb and the pointer finger, and a middle finger sensor array embedded in a distal end of one of the segments for the middle finger. The glove yet further includes a switch communicatively coupled to the thumb webbing sensor array and the middle finger sensor array and switched on by the thumb webbing sensor array and the middle finger sensor array. Finally, the glove includes a feedback element activated by the switch and a power source fixed to the hand enclosure powering the thumb webbing sensor array, the middle finger sensor array, the switch and the feedback element. In this way, the feedback element can be activated by the switch responsive to the sensor arrays sensing a correct positioning of a cue within the bridge hand of the cue sports player.

In one aspect of the embodiment, the glove lacks segments for the pinky finger and the ring finger. In another aspect of the embodiment, the feedback element can be include one or more alone or in combination:

- a light emitting diode (LED) lamp activated by the switch to emit light;
- a piezoelectric speaker activated by the switch to emit a tone; or
- a piezoelectric haptic vibrator activated by the switch to emit vibrations.

As such, during play, the cue sports player can receive immediate feedback once the cue sports player has properly positioned the cue on the bridge hand.

In yet another aspect of the embodiment, the glove includes a wireless transmitter fixed to the hand enclosure, coupled to the each of the thumb webbing sensor array and the pointer finger sensor array. The transmitter is then adapted to wireless transmit data received from the thumb webbing sensor array and the pointer finger sensor array to a mobile computing device. Examples of the data include pressure readings from each of the thumb webbing sensor array and the pointer finger sensor array which can be processed and visualized within a display of the mobile computing device.

In even yet another aspect of the embodiment, the thumb webbing sensor array and the pointer finger sensor array are pressure sensors. To that end, the switch activates responsive to a threshold minimum pressure sensed by the pressure sensors. As well, the switch deactivates responsive to a threshold maximum pressure sensed by the pressure sensors. In both instances, the threshold minimum pressure and the threshold maximum pressure are set by respective potentiometers fixed to the hand enclosure and coupled to each of the thumb webbing sensor array and the pointer finger sensor array.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for a performance monitoring bridge hand glove for cue sports cues. The glove includes a hand enclosure enclosing the palm of the hand from which individual finger segments protrude. Those segments include a segment extending from the palm of the hand to at least a knuckle for each of a middle finger, a pointer finger and a thumb. Optionally, the glove can exclude segments for the pinky finger and the ring finger. The glove further includes a thumb webbing sensor array embedded in a webbing portion between the thumb and the pointer finger, and a middle finger sensor array embedded in a distal end of one of the segments for the middle finger.

The glove yet further includes a switch communicatively coupled to the thumb webbing sensor array and the middle finger sensor array and switched on by the thumb webbing sensor array and the middle finger sensor array. Finally, the glove includes a feedback element activated by the switch and a power source fixed to the hand enclosure powering the thumb webbing sensor array, the middle finger sensor array, the switch and the feedback element. In this way, the feedback element can be activated by the switch responsive to the sensor arrays sensing a correct positioning of a cue within the bridge hand of the cue sports player.

Figure 1A:
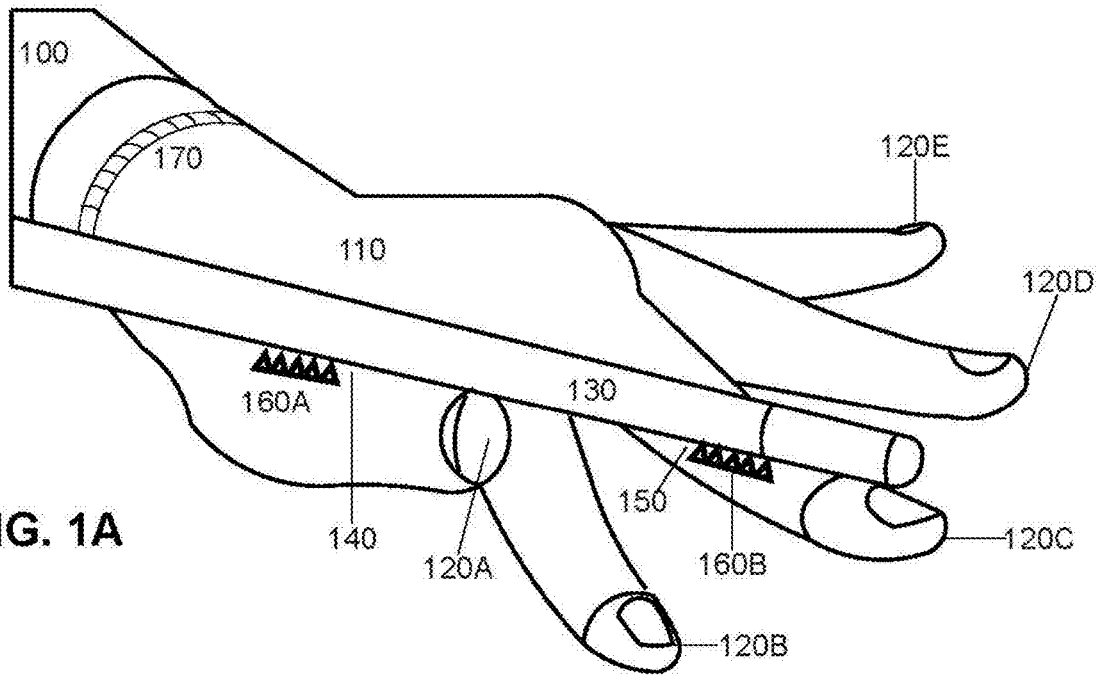
FIGS. 1A and 1B, taken together, are a pictorial illustration of a bridge hand glove for cue sports instrumented for performance monitoring.
Figure 1B:
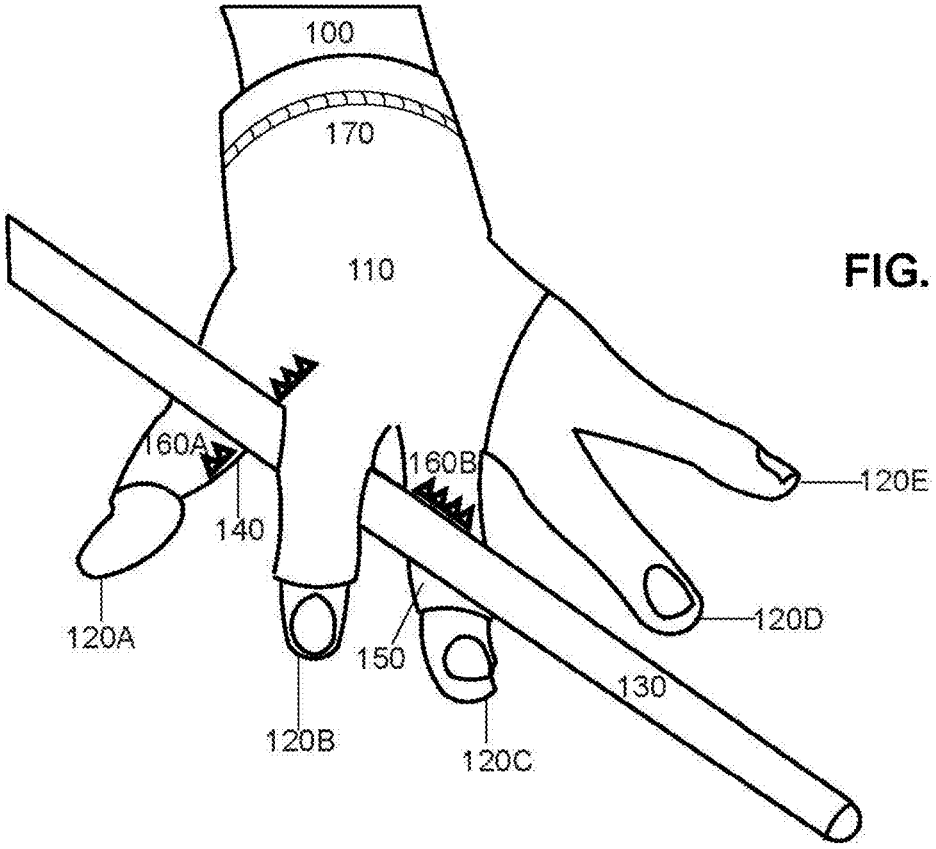

In further illustration, FIGS. 1A and 1B, taken together, are a pictorial illustration of a bridge hand glove for cue sports instrumented for performance monitoring. As shown in FIGS. 1A and 1B, a bridge hand glove 110 can be worn on the hand of an arm 100 operating a bridge portion of a billiards cue 130. The bridge hand glove 110 can include for each of a thumb 120A, pointer finger 120B and middle finger 120C, different segments protruding from a palm of hand towards a knuckle of the respective one of the fingers 120A, 120B, 120C. Preferably, the glove 110 excludes segments for the ring finger 120D and pinky finger 120E. A thumb webbing sensor 160A is embedded at a portion of the glove 110 between the knuckle of the thumb 120A towards a webbing 140 between the thumb 120A and the pointer finger 120B terminating at a distal end of the webbing 140. A middle finger sensor 160B is embedded at a portion of the glove 110 on a middle finger dorsal position 150.

The sensors 160A, 160B can be photonic sensors sensing changes in visible light resulting in from a placement of the billiards cue 130 across a surface of each of the sensors 160A, 160B. The sensors 160A, 160B alternatively can be proximity sensors sensing a proximity of the billiards cue 130 as the billiards cue is placed across the surface of each of the sensors 160A, 160B. The sensors 160A, 160B is yet another alternative can be pressure sensors sensing different degrees of pressure resulting from a placement of the billiards cue 130 across the surface of each of the sensors 160A, 160B. Finally, the sensors 160A, 160B can be contact sensors sensing simple contact resulting from a placement of the billiards cue 130 across the surface of each of the sensors 160A, 160B.

Of note, the glove 110 includes a feedback element 170, such as a lamp, or LED strip. The feedback element 170 responds to an activation of the sensors 160A, 160B, such as when the billiards cue 130 contacts both sensors 160A, 160B. Optionally, where the sensors 160A, 160B are pressure sensors, the feedback element 170 responds only when a minimum threshold pressure is detected at each of the sensors 160A, 160B. As yet another option, the feedback sensors 160A, 160B deactivate when a pressure beyond a maximum threshold is detected by the sensors 160A, 160B. In other aspects of the embodiment, the feedback element 170 is a piezoelectric speaker emitting a tone when responding to the sensors 160A, 160B. In yet other aspects of the embodiment, the feedback element 170 is a haptic element emitting vibrations when responding to the sensors 160A, 160B.

Figure 2:
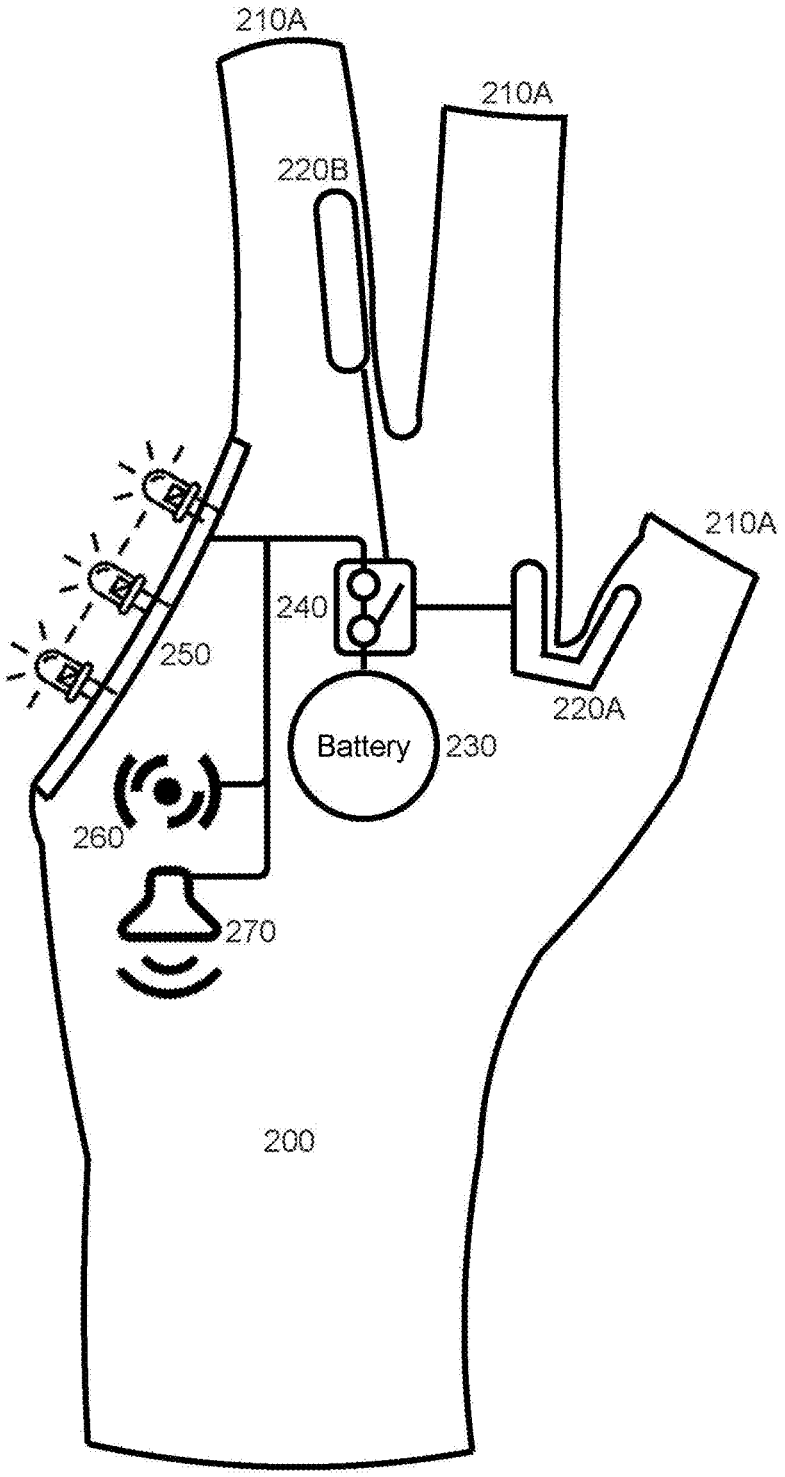
FIG. 2 is a schematic illustration of the bridge hand glove of FIG. 1; and, FIG. 3 is a block diagram showing an electronics architecture for the glove of FIG. 2.

The glove can have a varying electromechanical architecture. To that end, FIG. 2 schematically shows one possible architecture of the bridge hand glove of FIG. 1. As shown in FIG. 2, the glove 200 includes different segments 210A extending from at least the thumb, pointer finger and middle finger. A thumb webbing sensor 220A is embedded at a thumb webbing between two of the segments 210A of the glove 200 between the thumb and the pointer finger, and can include an array of pressure sensors, for instance. A middle finger sensor 220B is embedded at a dorsal portion of the segment 210A of the middle finger and also can include an array of pressure sensors.

Both sensors 220A, 220B are powered by battery 230 embedded on a dorsal surface of the glove 200. One or more feedback elements 250, 260, 270 are fixed to different portions of the glove 200. The feedback elements 250, 260, 270 include a visual feedback element 250, a haptic feedback element 260 and an audible feedback element 270. The feedback elements 250, 260, 270 are togglably electrically coupled to the battery 230 by way of a switch 240 activatable by sensors 220A, 220B. It is to be understood that as a matter of design choice, one or more resistive elements, and one or more capacitive elements may be included as auxiliary electronic components in the electrical signaling pathway between the sensors 220A, 220B and the battery 230, and in the electrical signaling pathway between the feedback elements 250, 260, 270 and the battery 230.

Figure 3:
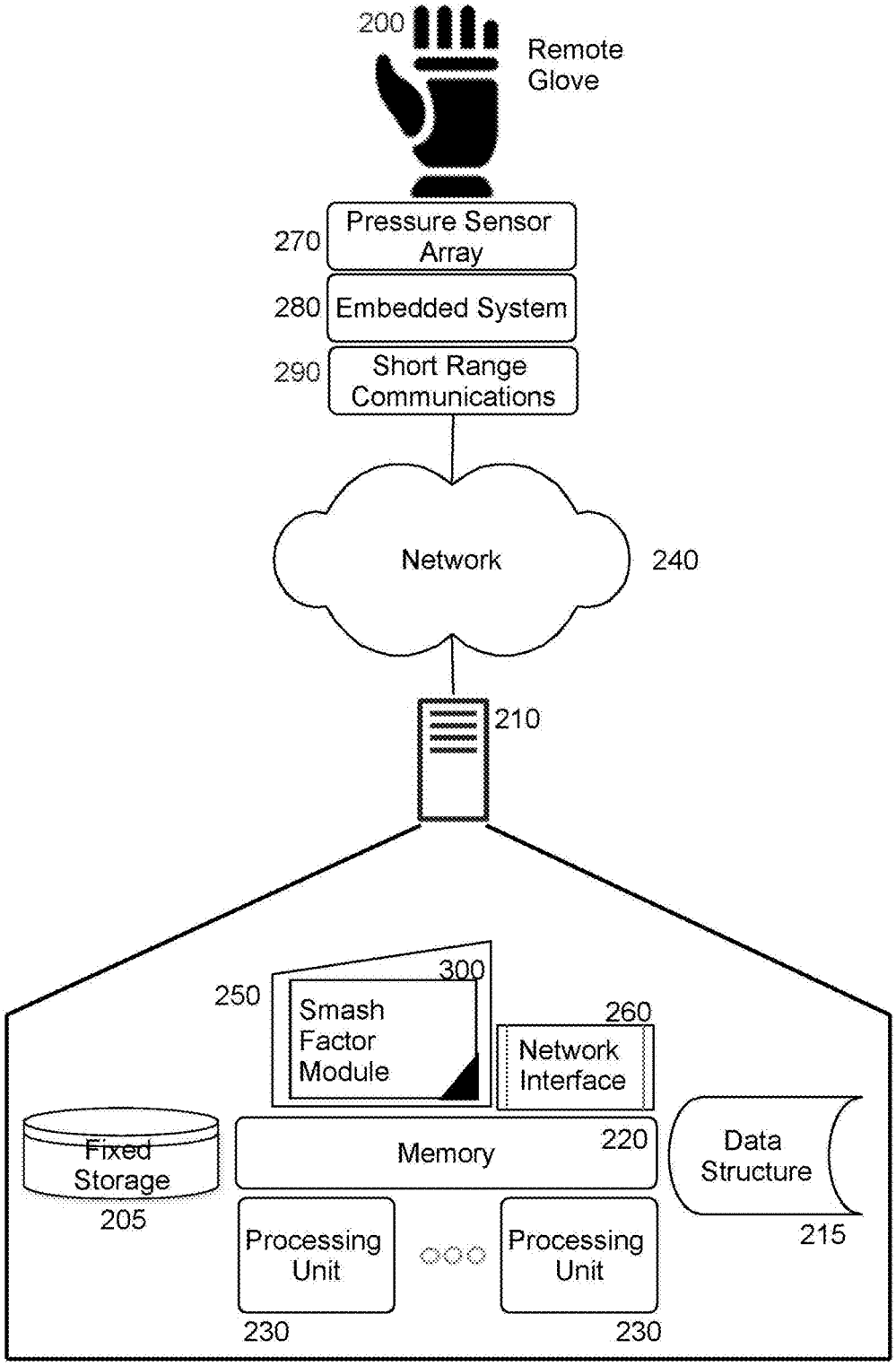

Notably, in one embodiment, the glove 200 operates as a standalone playing tool to indicate when a billiards cue has been properly positioned on the bridge hand of the player. In other embodiments, the glove 200 operates as a larger part of a data processing system analyzing the operation of the billiards cue as sensed by the sensors 220A, 220B of the glove 200. In respect to the latter embodiments, FIG. 3 is a block diagram showing an electronics architecture for the glove of FIG. 2. As shown in FIG. 3, a bridge hand globe 200 is instrumented with a pressure sensor array 270 at the thumb webbing between the thumb and the pointer finger, and at a dorsal surface of the middle finger. An embedded system 280 processes pressure and time stamp data received from the pressure sensor array 270 and transmits the collected data from the pressure sensor array 270 using short range communications circuitry 280 over data communications network 240 to a host computing platform 210.

The host computing platform 210 includes memory 220, one or more central processing units 230 and fixed storage 205. The host computing platform 210 also includes a network interface 260 through which the pressure sensor data and time stamp data is received from the short range communications circuitry 290 of the glove 200. Of note, the host computing platform 210 includes a non-transitory memory 250 storing thereon computer program instructions of a smash factor module 300. The program instructions are enabled to construct a data structure 215 in memory with the received pressure data and time stamp data so as to correlate each received data point of pressure with respect to a time when the data of the data point had been sensed.

Specifically, the program instructions further can access the data structure 215 in order to compute a velocity of movement of a billiard cue handled by the glove 200 based upon a change in pressure data over time at the thumb webbing and dorsal surface. By way of example, a prolonged sensing of equivalent or near equivalent pressure across the thumb webbing and the dorsal surface can be indicative of a low velocity movement of the billiards cue, whereas a rapid increase in pressure across the thumb webbing and the dorsal surface followed by a rapid decrease in pressure across the thumb webbing and the dorsal surface can be indicative of a high velocity movement of the billiards cue. A smash factor is then computed with the determined velocity as a variable input so that the wearer of the glove can ascertain a smash factor of the billiards cue colliding with a cue ball according to the determined velocity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "include", "includes", and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A performance monitoring bridge hand glove for cue sports cues comprising:

a hand enclosure including segments from a hand portion corresponding to a human hand to at least a knuckle portion corresponding to a knuckle of the human hand for each of a middle finger portion corresponding to a middle finger of the human hand, a pointer finger portion corresponding to a pointer finger of the human hand and a thumb portion corresponding to a thumb of the human hand;

a thumb webbing sensor array embedded in a webbing portion between the thumb portion and the pointer finger portion;

a middle finger sensor array embedded in a distal end of one of the segments for the middle finger portion;

a switch communicatively coupled to the thumb webbing sensor array and the middle finger sensor array and configured to be switched on by a concurrent activation of both the thumb webbing sensor array and also the middle finger sensor array;

a feedback element activated by the switch; and, a power source fixed to the hand enclosure and configured to power the thumb webbing sensor array, the middle finger sensor array, the switch and the feedback element.

2. The performance monitoring bridge hand glove of claim 1, wherein the performance monitoring bridge glove lacks segments for a pinky finger portion corresponding to the human hand and a ring finger portion corresponding to the human hand.

3. The performance monitoring bridge hand glove of claim 1, wherein the feedback element is a light emitting diode (LED) lamp activated by the switch to emit light.

4. The performance monitoring bridge hand glove of claim 1, wherein the feedback element is a piezoelectric speaker activated by the switch to emit a tone.

5. The performance monitoring bridge hand glove of claim 1, wherein the feedback element is a piezoelectric haptic vibrator activated by the switch to emit vibrations.

6. The performance monitoring bridge hand glove of claim 1, further comprising a wireless transmitter fixed to the hand enclosure, coupled to the each of the thumb webbing sensor array and the middle finger sensor array and adapted to wirelessly transmit data received from the thumb webbing sensor array and the middle finger sensor array to a mobile computing device.

7. The performance monitoring bridge hand glove of claim 1, wherein the thumb webbing sensor array and the middle finger sensor array are pressure sensors.

8. The performance monitoring bridge hand glove of claim 7, wherein the switch activates responsive to a threshold minimum pressure sensed by the pressure sensors.

9. The performance monitoring bridge hand glove of claim 8, wherein the switch deactivates responsive to a threshold maximum pressure sensed by the pressure sensors.

10. The performance monitoring bridge hand glove of claim 9, wherein the threshold minimum pressure and the threshold maximum pressure are set by respective potentiometers fixed to the hand enclosure and coupled to each of the thumb webbing sensor array and the middle finger sensor array.

* * * * *